US006392961B1

(12) United States Patent
Chiam et al.

(10) Patent No.: US 6,392,961 B1
(45) Date of Patent: May 21, 2002

(54) REAL-TIME CLOCK FOR CONSUMER DEVICES AND METHOD FOR IMPLEMENTING SUCH A CLOCK

(75) Inventors: Thor Itt Chiam, Sydney (AU); Chen Leong Thong, Seremban (MY)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 09/155,585

(22) PCT Filed: Apr. 1, 1997

(86) PCT No.: PCT/EP97/01692

§ 371 Date: Apr. 16, 1999

§ 102(e) Date: Apr. 16, 1999

(87) PCT Pub. No.: WO97/37287

PCT Pub. Date: Oct. 9, 1997

(Under 37 CFR 1.47)

(30) Foreign Application Priority Data

Apr. 1, 1996 (GB) ..... 9606849

(51) Int. Cl.[7] ..... G04B 47/00
(52) U.S. Cl. ..... 368/47; 368/10
(58) Field of Search ..... 368/10, 47

(56) References Cited

U.S. PATENT DOCUMENTS 4,672,642 A * 6/1987 Willis et al. ..... 368/156
4,763,193 A * 8/1988 DeVilbiss ..... 368/156
5,668,915 A * 9/1997 Baik et al. ..... 368/46
5,677,895 A * 10/1997 Mankovitz ..... 368/10
5,881,022 A * 3/1999 Morganstein ..... 368/46

FOREIGN PATENT DOCUMENTS

| | | |
|---|---|---|
| DE | 4403124 | 3/1995 |
| FR | 2669791 | 5/1992 |
| JP | 2-275392 | 9/1990 |

OTHER PUBLICATIONS

Copy of Search Report Attached Patent Abstracts of Japan, vol. 015, No. 037, Jan. 29, 1991 and JP 2–275392.

* cited by examiner

*Primary Examiner*—Bernard Roskoski
(74) *Attorney, Agent, or Firm*—Joseph S. Tripoli; Robert D. Shedd

(57) ABSTRACT

Consumer electronic devices with the ability to receive TV signals such as TV sets or video cassette recorders include a clock for programming said device. Such clocks are controlled by quartz crystals which have some tolerances, the compensation of which are normally done by trimmer capacitors. The real-time clock according to the invention uses the sync signals of the vertical synchronization of a TV picture for the comparison with the oscillation of the quartz crystal. In dependence on said comparison, correction values are calculated. Further, a method for implementing a real-time clock in such a consumer device is given, wherein the real time is generated by adding time intervals of a prescribed length to the sum of former ones. For the correction of the so generated time, either a number of additional intervals is added if the real oscillator frequency is too low, or the adding of regular intervals is skipped for a number of intervals if the oscillator frequency is too high, wherein said number is computed by an internal processor of the device with the use of sync pulses included in the TV signal.

11 Claims, 2 Drawing Sheets

REAL-TIME CLOCK FOR CONSUMER DEVICES AND METHOD FOR IMPLEMENTING SUCH A CLOCK

BACKGROUND OF THE INVENTION

1) Field of the Invention

The invention relates to a real-time clock for consumer devices having the ability to receive TV signals, and in particular to a real-time clock for a VCR and a method for implementing such a clock.

2) Background Art

Today every VCR has a clock feature for the purpose of timer recording. This clock should be as accurate as possible, so that programmed timer recording can start and stop at the correct time provided by the user.

There are several ways to implement such a clock. One method makes, for example, use of a 16 MHz crystal oscillator, a component being required by the microcontroller of the VCR. But such a 16 MHz crystal oscillator shows a frequency tolerance, so that the use of such a crystal oscillator in implementing a real-time clock results in an accuracy problem. Therefore the resulting real-time clock does not show the correct time, in other words, the real-time clock accuracy will vary. This problem can be overcome by adjusting the oscillator frequency to an acceptable range using a trimmer capacitor, so that an accuracy of one second in 24 hours will be achieved. But such a trimmer capacitor results in higher costs and its capacitance must be adjusted as a function of the real oscillator frequency.

U.S. Pat. No. 4,582,434 shows a time corrected, continuously updated clock, wherein the clock automatically scans several RF frequencies at which the coded RF timing signals are transmitted and periodically determines the timing difference between an internal timer and the received RF timing signals. Such RF timing signals are based on atomic clocks and are provided by various radio frequency transmitter stations synchronized with a master standard atomic clock. But such a time corrected, continuously updated clock needs additional electronic circuitry for the scanning of the RF signals, so that its use in consumer devices results in higher costs.

It is therefore an object of the present invention to provide a real-time clock for a consumer device being able to receive TV signals said clock having a high accuracy at comparatively low costs.

SUMMARY OF THE INVENTION

The invention is then for a clock of a consumer electronic device having a microprocessor, an oscillator with an ideal oscillation frequency (T) and a real oscillation frequency (F), the electronic device having the ability to receive TV signals, characterized in that the real oscillation frequency (F) of the oscillator is compared with a timing of received signals in order to calculate the exact value of the real frequency and from this calculation corrections are made to the number of oscillations of the oscillator. Said in an other way, an interval of time is determined in the following way. This interval of time is an integer number of periods of a periodic signal included in the TV signal. Such a periodic signal can be for instance the line synchronization signal or the vertical synchronization signal or any periodic signal carried by the television signal. If the time measured with the internal oscillator, i.e., the number of oscillations of said oscillator counted during said time interval, assuming that said oscillator has the ideal frequency, is greater than the real time measured by the number of periods of the TV signal, in which case the real period of the oscillator is greater than the ideal period, the correction will be made by not taking in account an integer number of oscillations of said oscillator each time said number of real oscillations is reached. If it is the reverse, then an integer number of counts will be added to the real count each time this number of real oscillations is reached. Of course the interval of time must be large enough so that it can differ from the time measured with the real oscillator from at least one period of oscillation of the real oscillator. Normally the interval will be large enough to differ with an integer number of periods.

In the preferred embodiment, the real oscillation frequency of the oscillator is compared with the sync signals of the vertical synchronization of a TV picture.

The invention has the advantage that no extra circuitry for the detection of a RF timing signal is necessary, because, for example, in a VCR the sync signal is inherently present and the accuracy of the sync signal is sufficient high for comparison purposes. Generally, any signal which is accurate enough can be used, like teletext signals, videotext signals, and any other signal transmitted together with a TV-signal or received on another way.

The device according to the invention is more simple than devices of the prior art. It includes no capacitor to adjust the frequency of the internal oscillator nor specific circuit to extract a signal devoted to time purpose. The device according to the invention will use one input of the existing microprocessor (22) of the device to receive the pulses coming form the internal oscillator (24) and an other input to receive pulses (28) coming from an other existing circuit (20) of the device, said circuit being a circuit extracting (20) from the TV signal (26) synchronization (28) included in said signal.

Preferably the oscillator is a quartz crystal with an ideal oscillation frequency of 16 MHz. As has already been mentioned such an oscillator normally runs on a slightly different real oscillation frequency.

For the calculation of the real time, the time amount (numerical) of a just lapsed time interval based on the ideal oscillator frequency is added to the sum of the former time intervals at the end of said, just lapsed time interval. The end of an interval is determined with the real frequency of the oscillator. To compensate the effect of different real oscillation frequency additional intervals are added to the sum of the former ones if the real oscillator frequency is too low compared to the ideal oscillator frequency, because in such a case the count given by the clock is inferior to the count that would have been given if the real oscillator had an ideal frequency. If the real oscillator frequency is too high compared to the ideal oscillator frequency, adding of time intervals is set out for a definite number of intervals.

For the adding or skipping of the correct amount of additional intervals a parameter k is generated by the following relation:

$$k=B/(B-A)=F/(F-T),$$

wherein B is the measured time for a prescribed number of sync pulses measured with the real oscillator frequency and A is the ideal time for the to prescribed number of sync pulses based on the duration of the sync pulses.

For the calculation of the real time, i.e. the correction of the real oscillator frequency, either after k intervals the time amount of an additional interval and of the actual interval is added if the sign of k is negative, or after k intervals the adding of the actual interval, i.e. regular interval, is skipped if the sign of k is positive.

Preferably 80 vertical sync pulses are used for the measurement and the calculation of k. Further the prescribed interval is 512 $\mu$s long, but a different length can be chosen according to the needs.

Moreover, the invention makes use of software to compensate for the tolerance of the oscillator, which is implemented into the microprocessor of the VCR or TV, and thus the trimmer capacitor can be replaced with a chip capacitor which is less costly.

BRIEF DESCRIPTION OF THE DRAWINGS

A preferred embodiment of the invention will now be described with reference to the accompanying drawings, wherein.

DESCRIPTION OF THE PREFERRED EMBODIMENT

Figure 1:
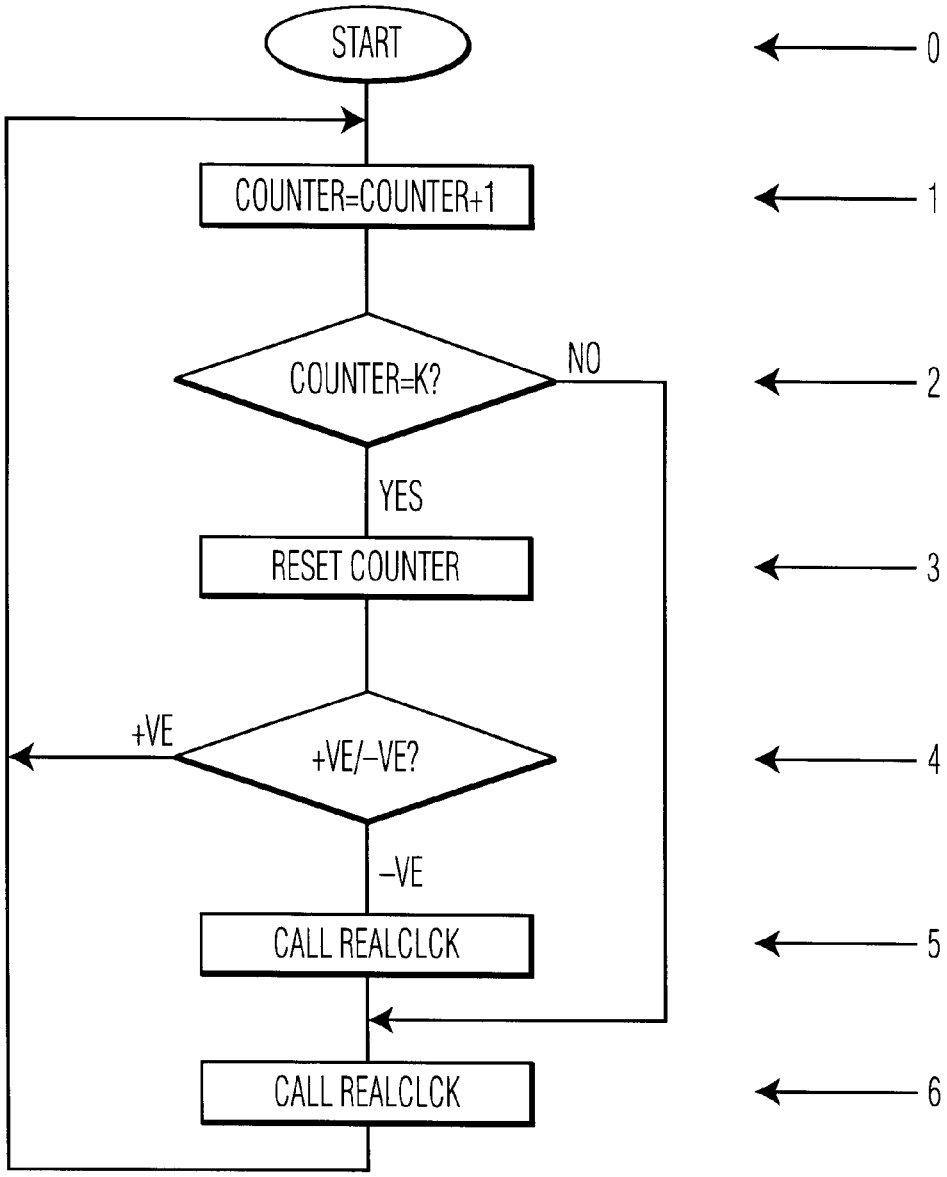
FIG. 1 shows a flow chart of the servo interrupt program.

Before giving a detailed explanation of the figures, the basic idea of the invention will now be described. The used microcontroller has time based counters and capture registers for time measurement. To measure the period of certain events, the time based counter value of a new capture is subtracted from the time based counter value of the last capture.

Depending on the operating frequency (16 MHz in this case) of the microcontroller, the resolution of the time based counter and thus the capture value will vary. However, the product of capture register resolution and capture value always represents the real time. For example:

(i) If the ideal oscillator frequency is 1 Hz, then the resolution $r_1$=1 s.

Thus after two seconds the capture value is: $c_1$=2.

(ii) If the real oscillator frequency is 2 Hz, then the resolution $r_2$=½ Hz=0,5 s. After two seconds the capture value is: $c_2$=4.

Therefore the respective products of resolution and capture value are always identical and represent the real time. In other words:

$$c_1 \times r_1 = c_2 \times r_{2-}$$

In the embodiment using an ideal oscillator frequency of 16 MHz, the servo interrupt occurs every 512 $\mu$s (=$2^{13}$/16 MHz) and calls the REALCLCK software routine to calculate the real-time clock. In 24 hours, the real clock software routine will be called 24×60×60 s/512 $\mu$s=168,750,000 times.

However, if the real oscillator frequency F deviates from the ideal frequency T (=16 MHz in the preferred embodiment), the servo interrupt will occur every $1/F \times 2^{13}$s. Thus the real clock software routine will be called a number of times which is greater or smaller than 168,750,0000 times in 24 hours and the resulting clock will either be faster or slower.

To get an exact clock, the REALCLCK software routine needs to be called exactly 168,750,000 times. To achieve this when the oscillator frequency is not exactly 16 MHz, the REALCLCK software routine needs to be called more or less frequently to compensate for the difference, so that the total call to the REALCLCK software routine is 168,750,000. To achieve this aim the following calculations are made:

The real frequency of the oscillator is F. Then the Servo interrupt interval t is:

$$t = 1/F \times 2^3 \text{ seconds } (2^3 \text{ depends on the capture register})$$

The number s of times Realclck software routine is called in 24 hours is $$s = 24 \times 60 \times 60/t$$

Therefore the difference d in the number of calls is:

$$d = s - 168{,}750{,}000 \text{ times}$$

In other words a factor k can be defined as:

$$k = s/d = F/(F - 16 \text{ Mhz})$$

wherein one more/less call must be done every k times.

FIG. 1 depicts the so called "servo software", wherein a counter is used to keep track of the number of servo interrupts. In the preferred embodiment the interrupts occur every $t = 2^{13}/F$ seconds. When this counter reaches k, the counter is reset and depending on the sign of the factor k, an additional REALCLCK software routine is called or skipped. In other words an additional amount of time is either added or the addition of the actual interval is skipped.

FIG. 1 shows the flowchart of the above described routine. After the START in step 0, a counter for keeping track of the number of servo interrupts is increased by 1 in step 1. Step 2 compares the actual value of the counter with the value of k. If the counter value equals the value k then the counter is reset in step 3. If the answer of the comparison is no, then the program proceeds to step 6. In step 4 the sign of k is examined. If the sign of k is positive, then the program returns to step 1. If the sign is negative, then the program proceeds to step 5 and calls for the routine REALCLCK, which is not explained in detail, but which just calculates the actual real time by adding an additional interval to the sum of the former intervals. Then the program proceeds to step 6, where the routine REALCLCK is called again. When step 6 is finished, the program returns to step 1.

Next, the calculation of the value of k is given:

From the well known relation:

Time=(ideal capture value, A)×(ideal resolution value, B)=(measured capture)×(measured resolution)

which reads: A/16 Mhz=B/F or:

$$F = B/A \times 16 \text{ Mhz}$$

and $$k = F/(F - 16 \text{ Mhz})$$

follows:

$$k = B/A \times 16 \text{ Mhz}/(B/A \times 16 \text{ Mhz} - 16 \text{ Mhz}) \quad k = B/A(B/A - 1) = B/(B - A)$$

It follows that:

k=measured value/difference

Figure 2:
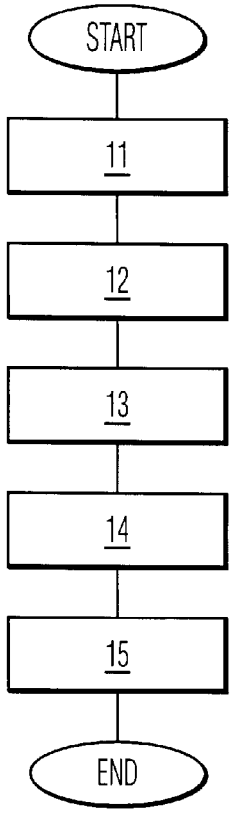
FIG. 2 shows a flow chart of the routine for measurement and calculation of the correction factor k.
Figure 3:
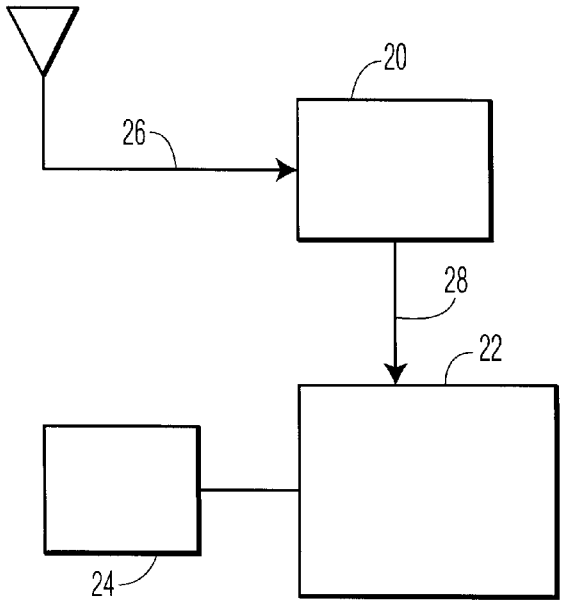
FIG. 3 shows a block diagram of the circuitry of the present invention.

FIG. 2 shows a flowchart of the used program for the calculation of the value of k using an amount of 80 sync pulses in the preferred embodiment, with the following steps:

Step 11: a first sync timing $t_0$ is defined using the capture register of a microcontroller (not shown) of the VCR;

Step 12: measures the timing of sync pulses $t_{80}$ (80 th vsync timing) using the capture register of the microcontroller;

Step 13: measures 80 vsync timing and calculates the difference b between $t_{80}$ and $t_0$ by forming the difference $t_{80}-t_0$, Step 14: the theoretical timing value A for 80 sync pulses is compared with the result of step 13 which gives the factor k=B/(B−A);

Step 15: the value of k is stored in memory so that it can be used in the servo interrupt routine of FIG. 1 to compensate for the clock calculation.

What is claimed is:

1. Clock for a consumer electronic device fitted with a microprocessor, an oscillator having an ideal oscillation frequency (T) and a real oscillation frequency (F), extracting circuit to extract from a received TV signal, synchronization pulses carried by said TV signal, wherein the microprocessor has an input coupled to the oscillator and an input coupled with the extracting circuit, the microprocessor having an internal software to compare and correct a timing of the real oscillation frequency (F) of the oscillator with a timing of said synchronization pulses of said TV signal so that a timing of said real oscillation frequency is synchronized with said timing or said synchronization pulses.

2. Clock according to claim 1, wherein said received signal is synchronization signal of a vertical synchronization of a TV picture.

3. Clock according to claim 1, wherein the oscillator is a quartz crystal.

4. Clock according to claim 3, wherein the ideal oscillation frequency (T) is 16 MHz.

5. Clock according to claim 1, wherein at the end of a prescribed time interval the time amount of the just lapsed time interval based on the ideal oscillator frequency (T) is added to the sum of the former ones, wherein the end of the actual interval is determined with the real frequency (F) of the oscillator, and that additional intervals are added to the sum of the former ones if the real oscillator frequency is too low, or that the adding of time intervals is set out for a definite number if the real oscillator frequency is too high compared to the ideal oscillator frequency.

6. Clock according to claim 1, wherein a parameter k is generated by $$k=B/(B-A)=F/(F-T),$$

wherein B is the measured time for a prescribed number of sync pulses A is the ideal time for the prescribed number of sync pulses, F is the real oscillation frequency of the oscillator and T is the ideal oscillation frequency.

7. Clock according to claim 6, wherein after k intervals the time amount of an additional interval and of the actual interval is added if the sign of k is negative, and that the adding of a regular interval is skipped for one interval if the sign of k is positive.

8. Clock according to claim 6, wherein 80 sync pulses are used for the calculation of k.

9. Clock according to claim 5, wherein the prescribed interval is 512 $\mu$s long.

10. Method for driving a real time internal clock of a consumer electronic device the steps comprising:

providing a microprocessor, receiving a TV signal from a circuit and extracting synchronization pulses included in the TV signal, said synchronization pulses of said TV signal having a period t1, providing an internal oscillator, said oscillator having an ideal frequency on which the internal clock is based, and an actual frequency corresponding to a period t2, receiving data representing a count of the synchronization pulses in said microprocessor, said data representing a count of the number of periods s2 delivered by the internal oscillator, the microprocessor having an internal software, computing a duration expressed by a number k of actual periods t2 of the internal oscillator duration at the end of which time measured from the count of the synchronization pulses of said TV signal and from the count of the periods t2 of the internal oscillator differ from one another by an integer number p of periods t2 in order to correct said value of time, storing said number k, and correcting said Value of time given by the clock by adding or skipping the number p of counts of the oscillator each time k oscillations of the oscillator are count.

11. Method for driving a real time internal clock of a consumer electronic device the steps comprising:

providing a microprocessor, receiving a TV signal by a circuit and extracting synchronization pulses included in the TV signal, said synchronization pulses of said TV signal having a period t1, providing an internal oscillator said oscillator having an ideal frequency on which the internal clock is based, and an actual frequency corresponding to a period t2, wherein counting for a predetermined number of periods t1 corresponding to a total duration t, a number B of counts, said number B being an integer number multiple of the actual number of beats given by the internal oscillator during duration t, so that each increase of one unit of B corresponds to an interval of time which is said inter multiple of the actual period t2 of the internal oscillator, to calculate a number A which would have been the value of B if the internal oscillator would have had the ideal frequency, and to calculate a coefficient k whose value is equal to the quotient of B by the difference between B and A, the value given by the internal clock being corrected by adding an interval each time the value of B is increased by a number equal to k when (B−A) is negative or by skipping an interval if (B−A) is positive.

* * * * *